US007806268B2

(12) United States Patent
Angelocci

(10) Patent No.: US 7,806,268 B2
(45) Date of Patent: Oct. 5, 2010

(54) INTERLOCKING DISPLAY FOR PRODUCTS

(75) Inventor: Nicole Marie Angelocci, Decatur, GA (US)

(73) Assignee: Goody Products, Inc., Atlanta, GA (US)

( * ) Notice: Subject to any disclaimer, the term of this patent is extended or adjusted under 35 U.S.C. 154(b) by 0 days.

(21) Appl. No.: 12/691,876

(22) Filed: Jan. 22, 2010

(65) Prior Publication Data

US 2010/0187154 A1 Jul. 29, 2010

Related U.S. Application Data

(60) Provisional application No. 61/146,767, filed on Jan. 23, 2009.

(51) Int. Cl.
*B65D 73/00* (2006.01)

(52) U.S. Cl. ..... 206/495; 206/806; 211/59.1

(58) Field of Classification Search ..... 206/806, 206/495, 487, 477, 482, 382, 45.28, 493, 206/6.1; 211/54.1, 57.1, 59.1, 72, 73, 195; 248/231.9, 248

See application file for complete search history.

(56) References Cited

U.S. PATENT DOCUMENTS 2,116,784 A * 5/1938 Geesaman ..... 211/57.1
3,013,668 A * 12/1961 Mennen ..... 211/40
3,050,183 A * 8/1962 Mueller, Jr. ..... 206/780
3,248,765 A * 5/1966 Achabal et al. ..... 248/222.11
3,799,357 A * 3/1974 Govang ..... 40/657
4,506,856 A 3/1985 Rich et al.
4,671,417 A * 6/1987 O'Brien ..... 211/59.1
5,193,466 A 3/1993 Eder
5,593,025 A * 1/1997 Feibelman ..... 206/6.1
6,149,111 A 11/2000 Epstein
6,286,690 B1 * 9/2001 Thalenfeld ..... 211/113
7,028,838 B1 * 4/2006 Rhoades ..... 206/419
2005/0184015 A1 * 8/2005 Cypranowski et al. ..... 211/73

* cited by examiner

*Primary Examiner*—Ehud Gartenberg
*Assistant Examiner*—King M Chu
(74) *Attorney, Agent, or Firm*—Gardner Groff Greenwald & Villanueva, P. C.

(57) ABSTRACT

A sheet of material is divided into front and rear panels and folds over on itself to a folded position. The front panel has flaps and immediately adjacent hanger openings formed in it. When the flaps are pivoted outward, the spaces they vacated define flap openings. Hangers project from the rear panel and align with their corresponding hanger openings. To assemble the display, the flaps are pivoted outward to their open positions and the sheet is folded to the folded position. As the sheet is being folded, the hangers swingingly extend through the hanger and flap openings, which together form a single continuous opening. Once in the folded position, the flaps are then pivoted back to their closed positions with the hangers extending through and interlocked with the hanger openings.

14 Claims, 8 Drawing Sheets

INTERLOCKING DISPLAY FOR PRODUCTS

CROSS-REFERENCE TO RELATED APPLICATION

This application claims the priority benefit of U.S. Provisional Patent Application Ser. No. 61/146,767, filed Jan. 23, 2009, which is hereby incorporated herein by reference.

TECHNICAL FIELD

The present invention relates generally to promotional displays and, in particular, to panel displays for displaying products.

BACKGROUND

The increased cost of raw materials has become a burden on many companies. One of the areas where there has been a significant cost increase is in corrugate materials. Product displays, such as point-of-purchase displays for promotional products, typically include a significant amount of corrugate material, and the cost increase has affected the profit margins earned by many companies. In addition, many retailers now require their suppliers to develop and use more environmentally friendly product packaging and displays.

Others have tried to reduce the cost of product displays by reducing the quality of their corrugate material. There are also known display designs that use less corrugate material, but these tend to be labor-intensive to assemble, be less sturdy in use, and/or require some sort of adhesive or grommet to assemble.

Accordingly, it can be seen that needs exist for improved product displays that use significantly less material, that are quick and easy to assemble, that are sturdy in use, and/or that are more environmentally sustainable. It is to the provision of solutions to these and other problems that the present invention is primarily directed.

SUMMARY

Generally described, the present invention relates to a display device for showing products. In a first example embodiment, the display includes a sheet of material and a plurality of hangers. The sheet of material has a fold line dividing it into front and rear panels and permitting the sheet to be folded along the fold line to a folded position. The front panel includes a number of hanger openings and a number of flaps immediately adjacent to each other in pairs. Each of the flaps has a fold line that it folds along between a closed position and an open position. In the closed position, the flaps are generally flush with the front panel and in the open position the flaps are pivoted forward and outward from the front panel. When the flaps are folded to the open position, flap openings are formed in the front panel by the spaces vacated by the flaps.

The hangers each include a base and a hanger arm that extends forward from the base. The bases mount to the rear panel and the products mount to the hanger arms. During assembly, the hanger arms swing through the immediately adjacent hanger and flap openings when the flaps are in the open position and the sheet is being folded to the folded position. The immediately adjacent hanger and flap openings form a single continuous opening, with the flap openings providing clearance for the hanger arms to swing through. Also, the hanger arms extend through the hanger openings and interlock with the flaps when the flaps are in the closed position and the products are mounted to the hanger arms. In this way, the display can be used to display more products while using less of the sheet material without sacrificing sturdiness, durability, or assembly time/cost.

In typical commercial embodiments, the front panel and the rear panel lie immediately adjacent each other in a generally flat arrangement when the sheet is in the folded position. Alternatively, they can be folded not all the way flat and instead left in a triangular arrangement. In typical commercial embodiments, the sheet is made of a corrugate material. Alternatively, it can be made of a plastic or other material. In typical commercial embodiments, the hanger arms have free ends that are angled upward to form hooks that retain the products on them. Alternatively, the hanger arms can be substantially linear or curved. In typical commercial embodiments, the hanger openings are positioned immediately above the corresponding flap openings. Alternatively, the hanger openings can be positioned immediately below the corresponding flap openings. In typical commercial embodiments, the hangers have hooks extending rearwardly from the hanger bases and the rear panel has mounting openings formed in it that receive the hanger-base hooks to secure the hangers to the rear panel. Alternatively, the hangers can be mounted to the rear panel using an adhesive, conventional fasteners, etc. In typical commercial embodiments, the fold lines are formed by scoring the sheet. Alternatively, the fold lines can be provided by un-scored lines or other indicia marked on the sheet.

In a second example embodiment, the display is similar to that of the first embodiment except with modified flaps. In the second embodiment, the flaps each have at least one vertical side extension that partially defines the corresponding hanger opening. For example, the flaps can each have two vertical side extensions that partially define the corresponding hanger opening between them. This provides lateral clearance for the hanger arms as they swing through the hanger and flap openings during assembly.

In another aspect, there is provided a pre-assembled package including one of the displays and a number of products for display. The display is assembled and the products are mounted to the hangers prior to shipment. When the package arrives, the product-laden display is ready for use.

The specific techniques and structures employed to improve over the drawbacks of the prior devices and accomplish the advantages described herein will become apparent from the following detailed description of the example embodiments and the appended drawings and claims.

DESCRIPTION OF EXAMPLE EMBODIMENTS

Figure 1:
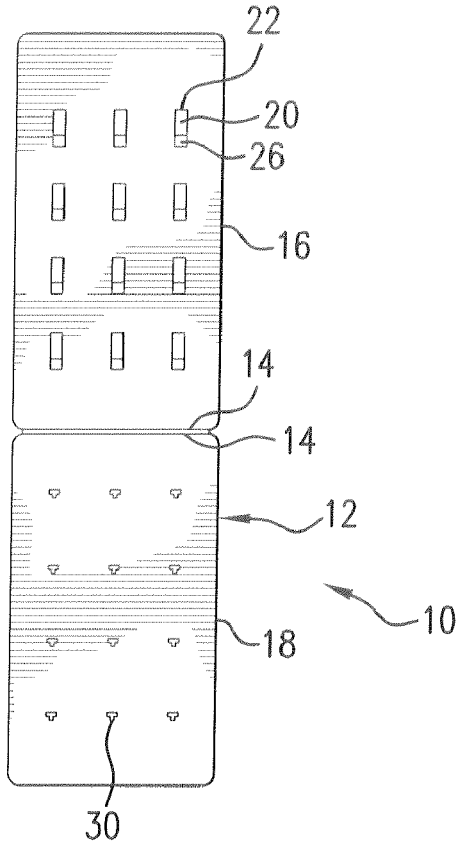
FIG. 1 is a front view of an interlocking display according to a first example embodiment of the present invention, showing front and rear panels of the display in a first unfolded position, without hangers.
Figure 2:
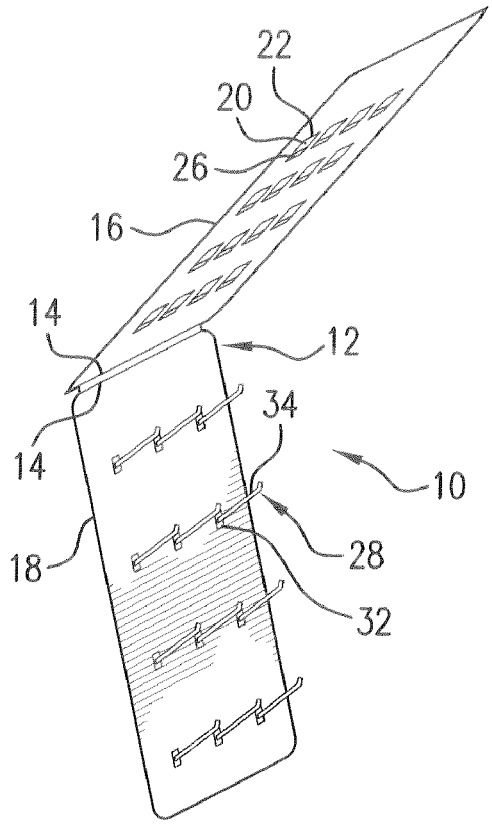
FIG. 2 is a perspective view of the display of FIG. 1, showing the display being folded to a second folded position, with the hangers shown.

Generally described, the present invention relates to an interlocking display for products such as hairstyling products and accessories. The example embodiments disclosed herein are specifically designed for use with such products. Persons of ordinary skill in the art will understand that the display can be used for displaying many other types of products, including demonstration objects not necessary for sale as well as products other than for hairstyling. As used herein, the term "product" means any object that is displayed for viewing for any purpose. Minor modifications may be beneficial for some such uses, and such modifications can be easily made by persons of ordinary skill in the art. For example, the display can be sized larger or smaller for displaying more or fewer products, it can be made of lighter- or heavier-duty materials for displaying products of varying weights, and/or it can be made with a circular, polygonal, or other regular or irregular shape, as may be desirable in a given application.

FIGS. 1-11 show an interlocking display 10 according to a first example embodiment of the present invention. The display 10 includes a generally rectangular sheet 12 of material with at least one folding line 14 (e.g., two parallel, closely spaced-apart lines are depicted) dividing the sheet into a front panel 16 and rear panel 18. The sheet 12 folds about the folding line 14 from a flat unfolded position (FIG. 1) to a flat folded position (FIG. 4) for use. In the folded position, the front and the rear panels 16 and 18 lie immediately adjacent each other in a generally flat arrangement. In the depicted embodiment, the folding line 14 is scored (with a continuous or intermittent line of grooves) for ease of folding the sheet 12, but it need not actually be scored as long as the sheet can be folded along the line. In a typical commercial embodiment, the sheet 12 is made of a corrugate material such as corrugated paperboard, fiberboard, or another cardboard material. In alternative embodiments, the sheet is made of another material such as a semi-rigid plastic, chipboard, or paperboard.

The front panel 16 has flaps 20 and folding lines 22 formed in it. In the depicted embodiment, the folding line 22 is scored (with a continuous or intermittent line of grooves) for ease of folding the flap 20, but it need not actually be scored as long as the flap can be folded along the line. The folding lines 22 permit the flaps 20 to pivot between a first closed position and a second open position. In the closed position, the flaps 20 are substantially flush with the front panel 16 (see FIGS. 1, 2, and 4). In the open position, the flaps 20 are pivoted forward/outward (about the folding lines 22) from the front panel 16 (see FIG. 3, top row of flaps). In the open position, the spaces that the flaps 20 occupied in the closed position are now empty and form flap openings 24 in the front panel.

In addition, the front panel 16 has hanger openings 26 formed in it, with these openings immediately adjacent to the flap openings 24. In effect, each hanger opening 26 and its immediately adjacent flap opening 24 cooperatively form one continuous larger opening in the front panel 26, with no physical structure between the paired hanger and flap openings. In the depicted embodiment, the hanger openings 26 are positioned immediately above the corresponding flap openings 24. In alternative embodiments, the hanger openings are positioned immediately below the corresponding flap openings.

The hanger openings 26, the flaps 20/flap openings 24, and the folding lines 14 and 22 can be formed in the sheet 12 by using conventional labor or tooling (e.g., die-cutting or scoring equipment) such as is used for making conventional corrugate displays. Thus, the hanger openings 26 can be cut into the front panel 16 and lines can be cut into the front panel so that portions of the front panel become the flaps 20.

The display 10 also includes hangers 28 that are mounted to the rear panel 18 in positions so that they align with and extend through the hanger openings 26 when the sheet 12 is in the folded position. This is in contrast to many conventional displays, in which hangers are mounted (e.g., glued) to the front surface of a single unfolded sheet. The hangers 28 each include a base 32 and an arm 34 projecting forward from the base. The hangers 28 can be mounted to the rear panel 18 by hooks 36 extending rearward from the hanger bases 32 that are received in mounting openings 30 (e.g., T-shaped openings as depicted, or vertical slots) formed in the rear panel 18 (see FIGS. 6 and 7). Alternatively, the hangers can be mounted to the rear panel by using an adhesive to bond the hanger bases to the inside surface of the rear panel, or by other conventional assembly methods known in the art. The hanger arms 34 can be angled upward at their free ends 38 to form a hook for retaining the products on the hangers 28. The hanger arms 34 can be made of plastic, metal, or another material selected for sufficient strength to support the products to be displayed.

Figure 3:
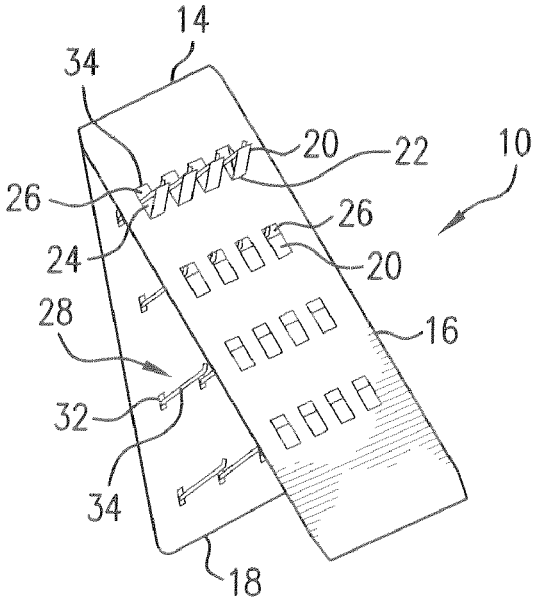
FIG. 3 is a perspective view of the display of FIG. 2 folded further so that the hangers of the top row extend through the front panel.
Figure 4:
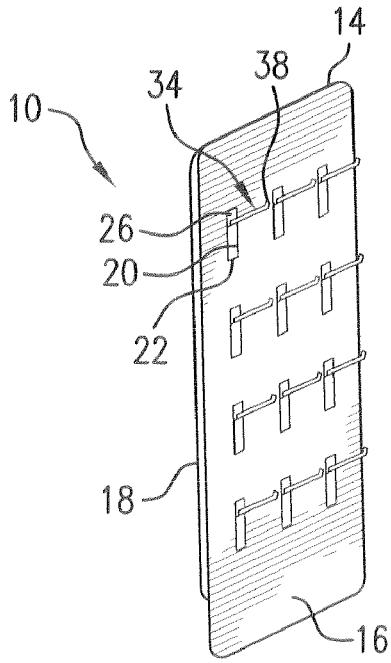
FIG. 4 is a perspective view of the display of FIG. 2, showing the display in the folded/use position with the hangers ready for use.
Figure 5:
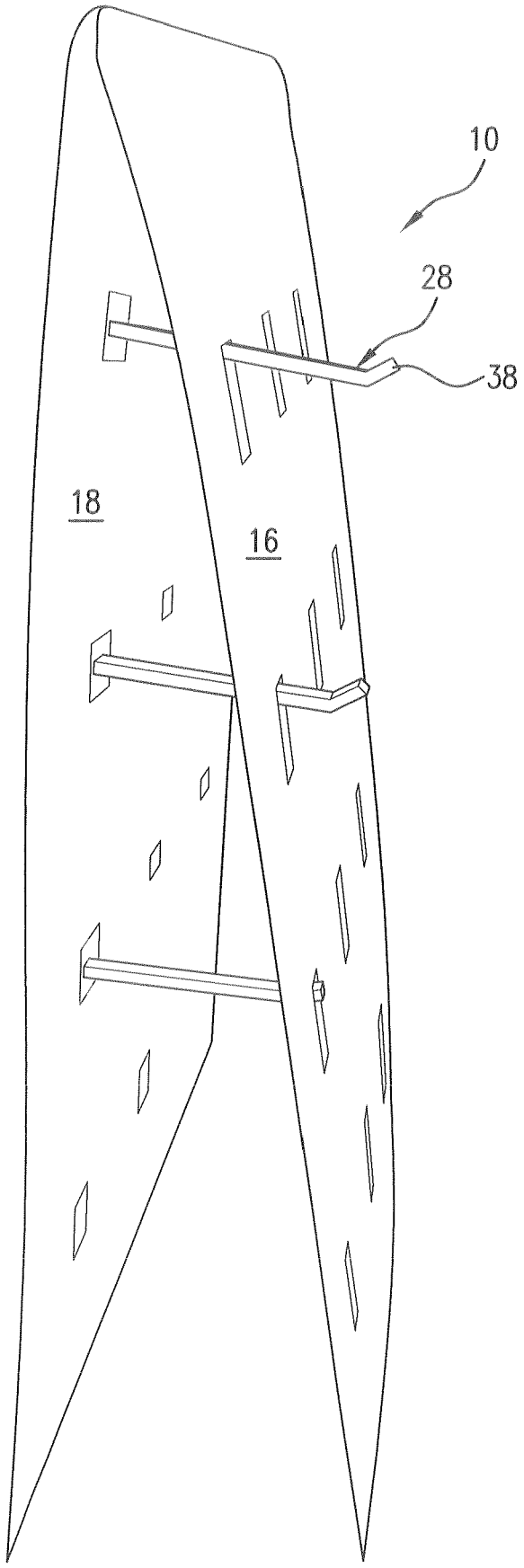
FIG. 5 is a perspective view of the display in the partially folded position of FIG. 3, showing only three of the hangers and none of the flaps for clarity of illustration.
Figure 6:
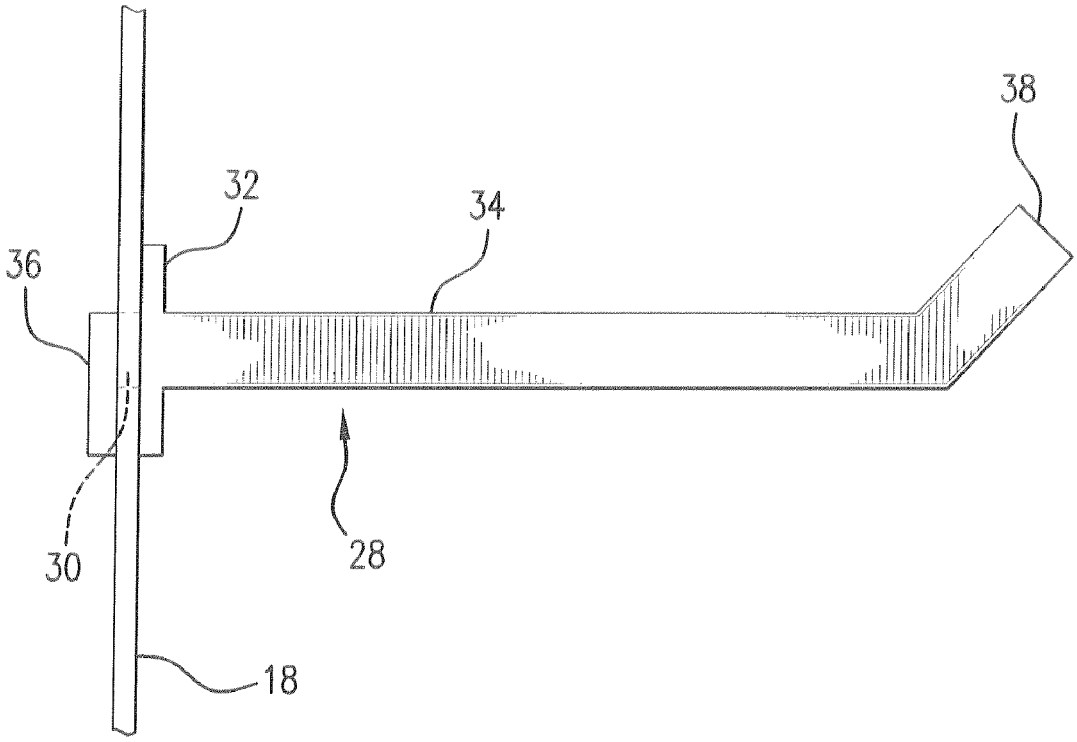
FIG. 6 is a side view of a portion of the display of FIG. 4, showing the mounting of one of the hangers to the rear panel.
Figure 7:
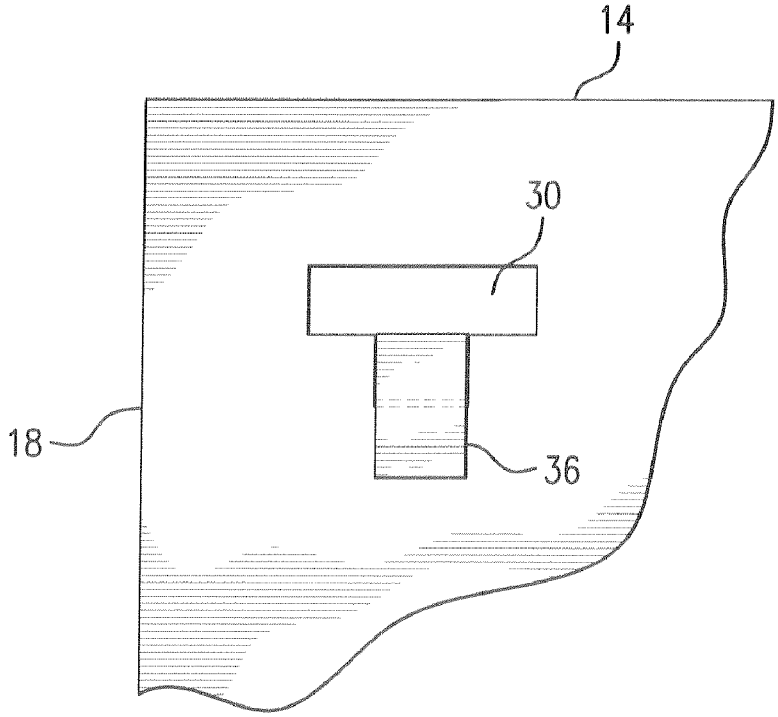
FIG. 7 is a rear view of the display portion of FIG. 6.
Figure 8:
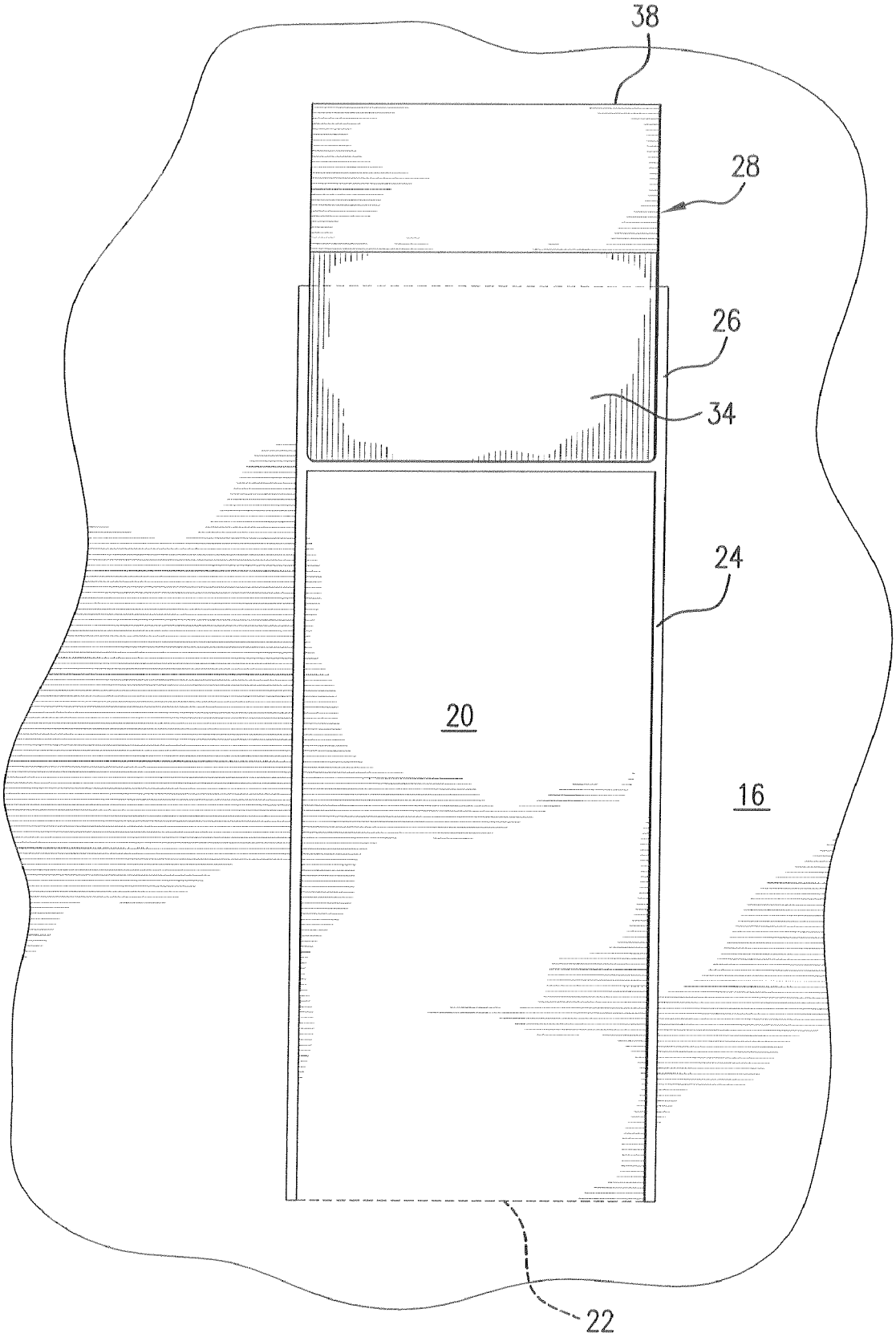
FIG. 8 is a front view of the display portion of FIG. 6, showing one of the hangers projecting through the front panel and held there with a snug fit.
Figure 9:
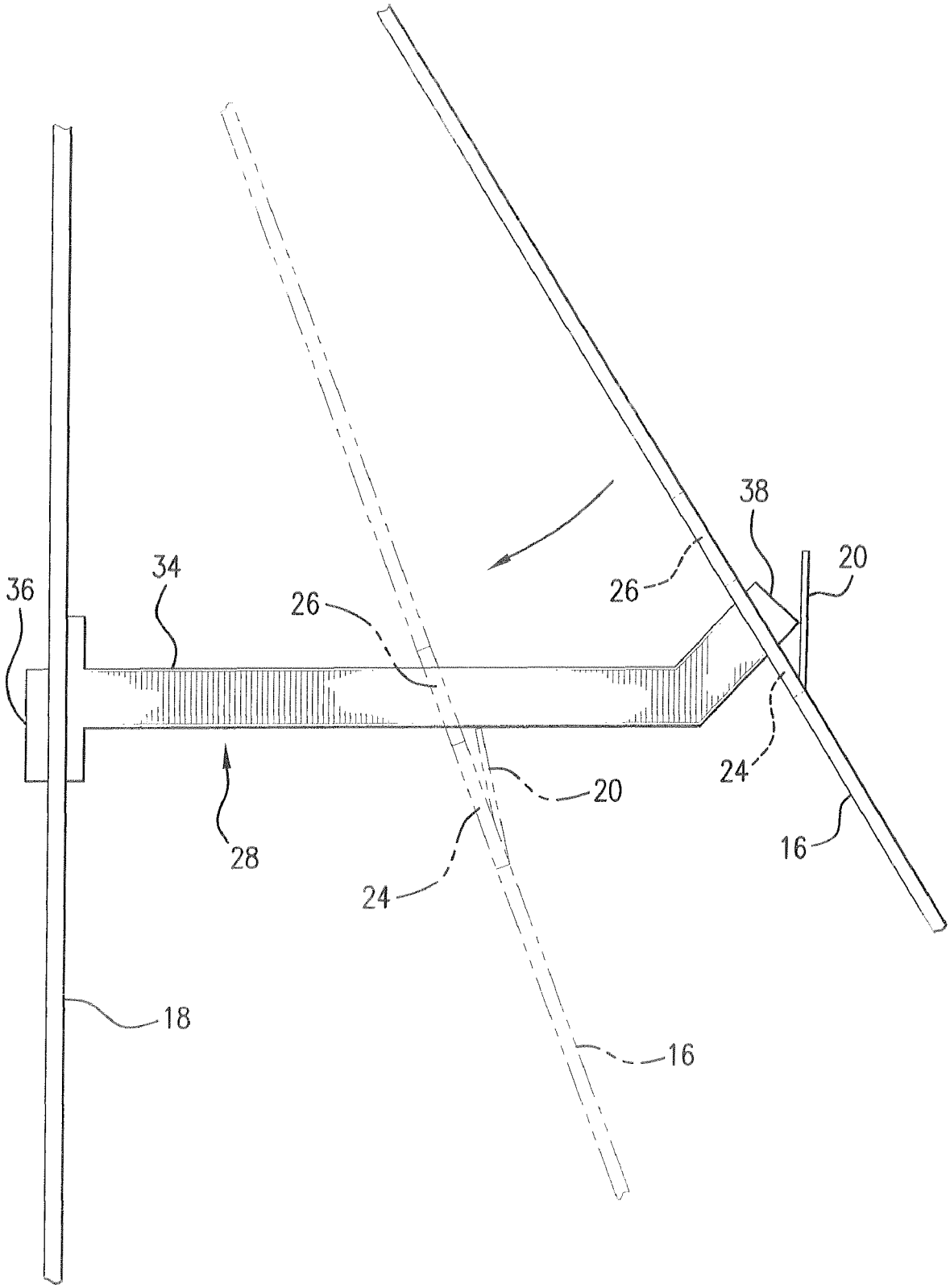
FIG. 9 is a side view of a portion of the display of FIG. 2, showing one the hangers extending through the front panel as the sheet is being folded over to the folded position.

The hanger arms 34 are swung through the hanger openings 26 and the flap openings 24 as the front panel 16 is being pivotally folded over onto the rear panel 18 with the flaps 20 in the open/pivoted position (see FIGS. 3, 5, and 9). Thus, the flap openings 24 provide the additional space needed, beyond the space provided by the hanger openings 26, for the hanger arms 34 to swing through as the sheet 12 is pivoted to the closed position (see FIG. 9). The flaps 20/flap openings 24 and the hanger openings 26 can be vertically elongated (as depicted) to provide the needed clearance for the hanger arms 34. The hanger openings 26 and the hanger arms 34 can be sized and shaped so that the hanger arms, when the flaps 20 are in the closed/flush position, are received within the hanger openings with a snug fit to hold them in place (see FIG. 7). In this way, the flaps 20 interlock with the hanger arms 34 to hold the front panel 16 and the rear panel 18 in place together when the weight of the products is applied to the hanger arms (e.g., by hanging products from them).

To assemble the display 10 for use, the flaps 20 are pivoted outward to their open positions and the sheet 12 is folded to the folded position. As the sheet 12 is being folded, the hangers 28 are extended through the hanger and flap openings 26 and 24, which together form a single continuous opening. After the sheet 12 is folded to the folded position, the flaps 20 are pivoted back to their closed positions with the hanger arms 34 extending through the hanger openings 26. In this way, the hangers 28 and front panel 16/flaps 20 are interlocked to provide a display that is easy to assemble and sturdy during shipment and use. And there is less material and labor required, because there is no need for separate/extra headers for promotional graphics/copy, tucks, gluing, and/or jean-wiring.

Figure 10:
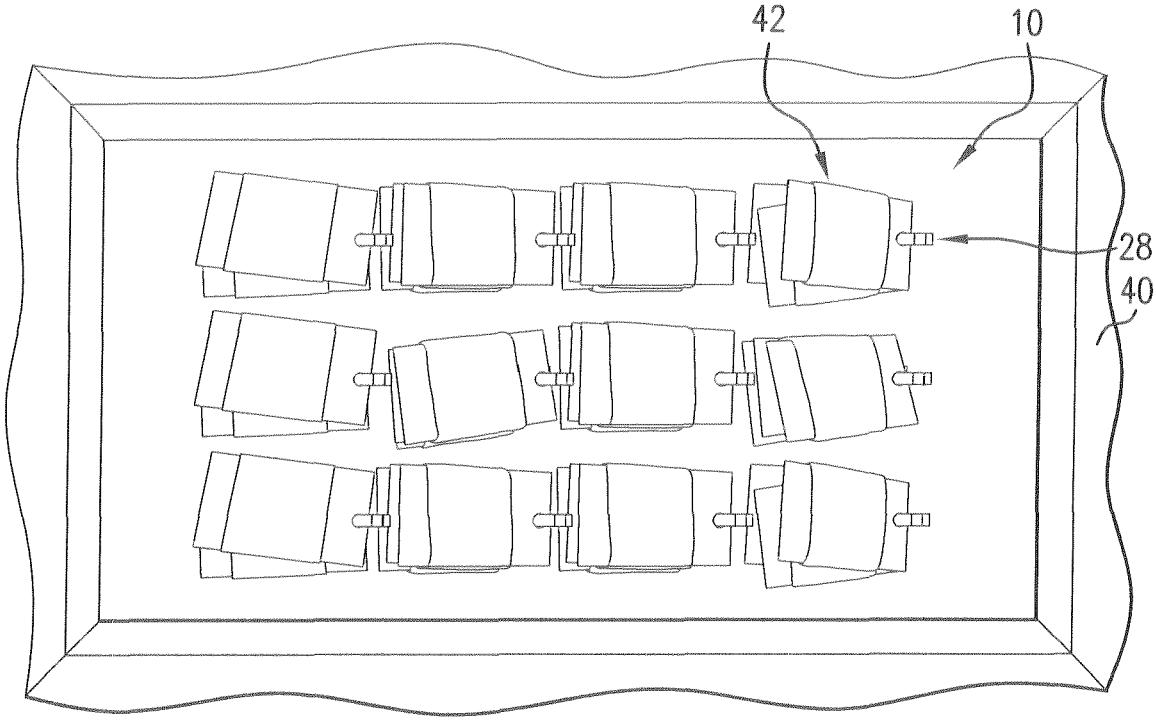
FIG. 10 is a front view of the display of FIG. 4 packaged in a box and loaded with products before a test shipment.
Figure 11:
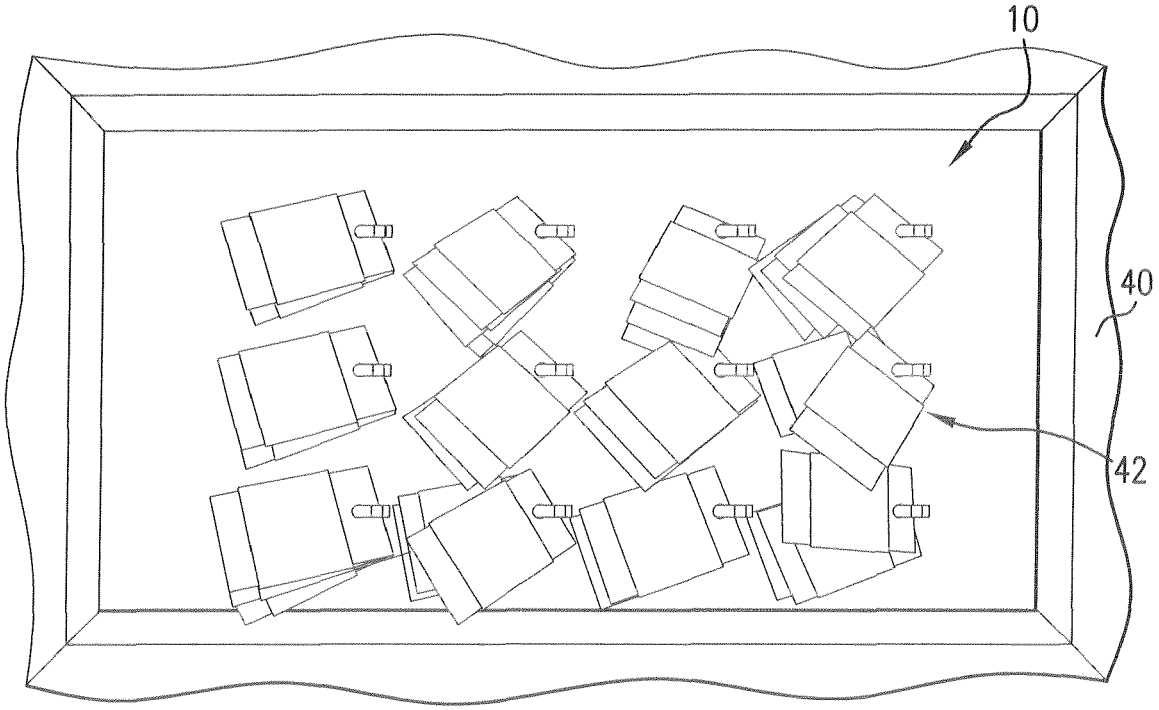
FIG. 11 shows the display and box of FIG. 8 after the test shipment.

With the hanger arms 34 snugly fit within the hanger openings 26, the flaps 20 interlock with and provide support to the hangers 28 during shipment and/or use, and the hanger base hooks 36 are held securely within the mounting openings 30. This was demonstrated by the assembly and test shipment of a sample display 10, as depicted in FIGS. 10 and 11. Products 42 were placed on the hangers 28 and the product-laden display 10 was placed in a conventional shipping container 40 (i.e., a corrugated cardboard box), as shown in FIG. 10. The box 40 containing the display 10 and products 42 was then subjected to a vibration test (with rotary motion) and a shock test (with a freefall drop) to simulate shipping by conventional delivery means, and passed the tests. Upon completion of the testing, the box 40 was opened and, while slightly jostled, the products 42 remained on the hangers 28, with the hangers intact in their display positions, as shown in FIG. 11. As the test demonstrated, the display 10 and products 42 can be shipped together in the assembled state, so there is no assembly required when the display is removed from its box 40 and set up for use by the retailer (i.e., the product-laden display arrives ready for use). Alternatively, the product can be shipped unassembled, with the products to be displayed shipped separately.

To use the display 10, it can be hung from separately provided hooks on a retail wire rack, mounted on a base of some sort, or otherwise positioned for displaying the products. Extra space can be provided at the top and/or bottom of the front panel 16 for graphics, reducing the need for an additional display and/or assembly piece.

In typical commercial embodiments, there are an array of the flap-and-opening sets and an array of the hangers in matching numbers. In alternative embodiments, the number and positions of the hangers and flap-and-opening sets can be customized to different display needs, including other regular or irregular spacings. In other alternative embodiments, the sheet is not folded all the way over on itself to a flat use position and instead the front and rear panels form an acute angle. In such embodiments, the hangers at lower positions can be longer than the hangers at higher positions so that they all extend beyond the front panel about the same distance, and this triangular design can be stood upright on a flat surface. In still other alternative embodiments, the hangers include lateral or vertical notches or protuberances at their bottom surfaces at a location where they engage mating protrusions or notches in the front panel (e.g., in the top edges of the flaps), so that the hangers can be slightly lowered to nest their notches/protrusions with the front-panel protrusions/notches to make the display more sturdy.

In still other alternative embodiments, the sheet of material is folded/hinged at the left or right side of the front panel or at the bottom of it. And in other alternative embodiments, the front panel and the rear panel are provided as two separate sheets of material, without folding, that are nested together.

Figure 12:
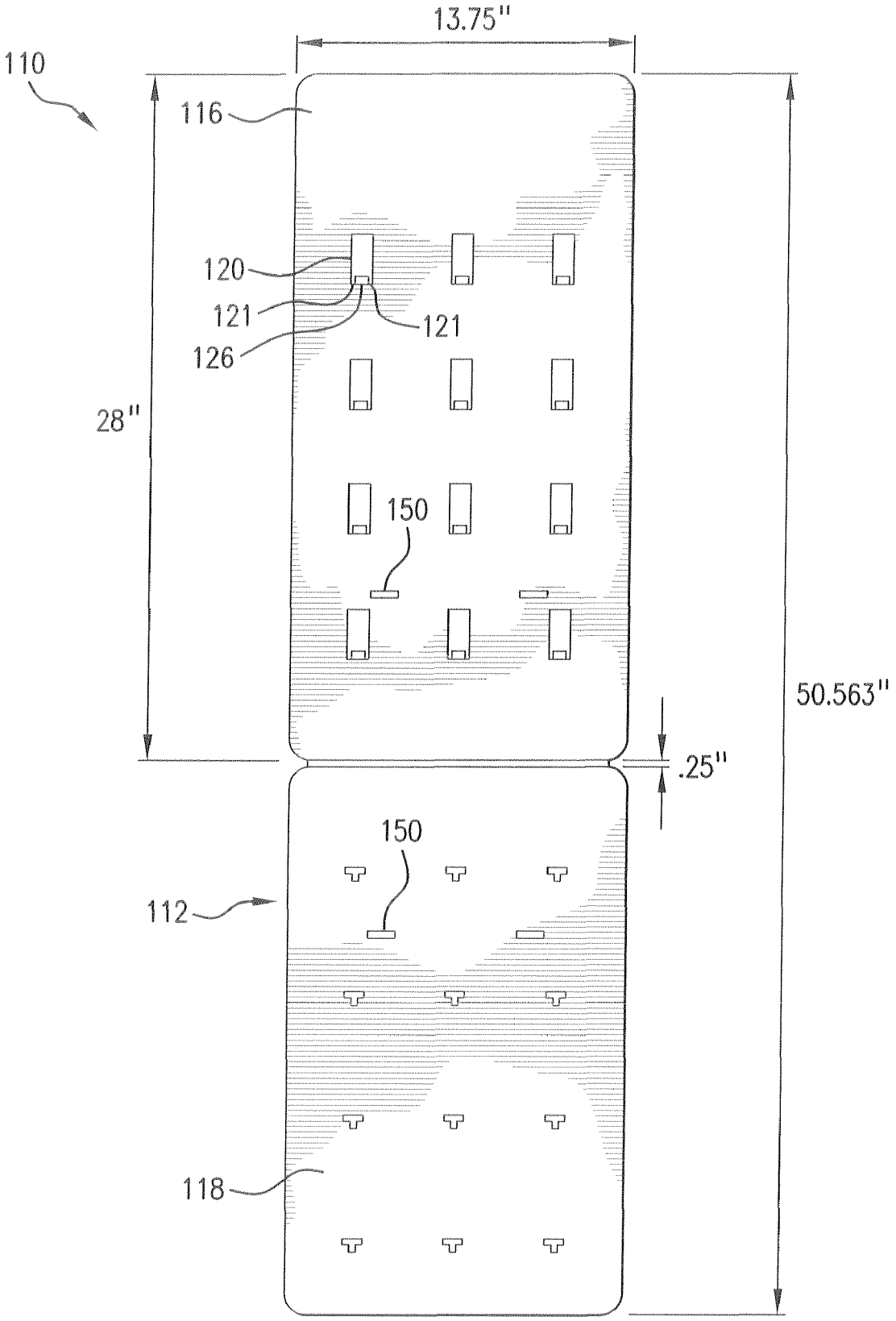
FIG. 12 is a front view of an interlocking display according to a second example embodiment of the present invention, showing the display in the unfolded position.
Figure 13:
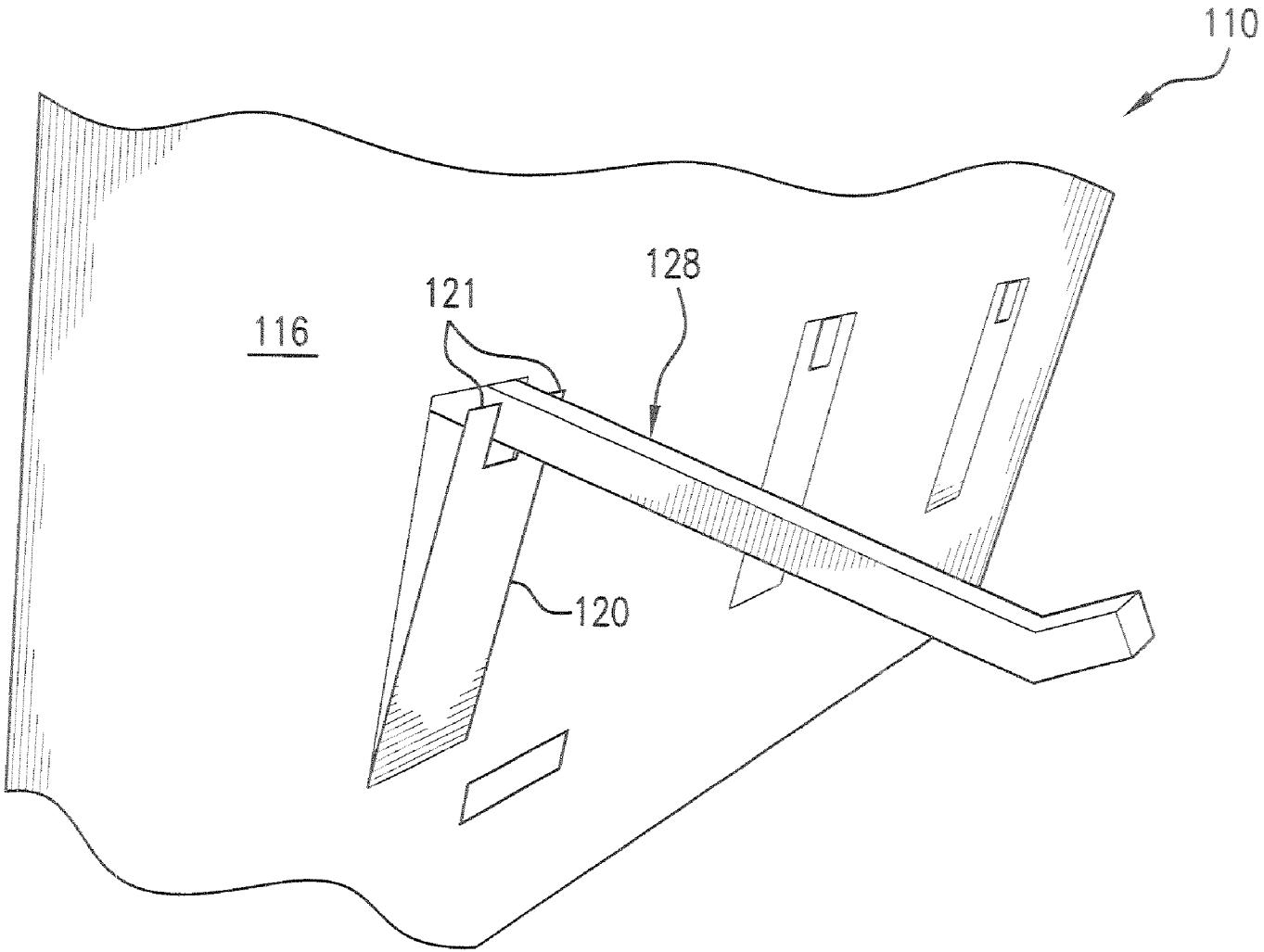
FIG. 13 is a perspective view of a portion of the display of FIG. 12, showing one of the hangers extending through one of the hanger openings.

FIGS. 12 and 13 show an interlocking display 110 according to a second example embodiment of the present invention. The display 110 is substantially the same as that of the first example embodiment. In this embodiment, however, the display 110 includes modified flaps 120 for use with hangers 128 having the same or narrower cross-sectional widths. In particular, the flaps 120 each have two vertical side extensions 121 for partially defining the hanger openings 126 between them. This allows the hangers 128 to swing through the hanger and flap openings more easily (i.e., with more lateral clearance) during assembly, while better securing the hangers 128 in place within the hanger openings 126 for use, resulting in a more stable display. In addition, the front and rear panels 116 and 118 can have one or more sets of slots 150 that align when the sheet is folded over into the folded position for receiving and securing lateral braces (not shown) for added sturdiness and/or for receiving mounting hardware such as conventional S-hooks for hanging the display.

The dimensions shown in FIG. 12 are representative of a typical commercial embodiment, and are not limiting of the invention. In the depicted display 110, the single sheet of material 112 has overall dimensions of 13.75 inches by 51.25 inches, whereas a common conventional display for the same number and type of hairstyling accessories includes a single unfolded sheet of corrugate material that is 36.25 inches by 28.875 inches. So the material usage is reduced by about 32% for a display for the same number and type of products, without sacrificing durability or strength.

The displays disclosed herein are well-suited for use as half side rack ("HSR") and full side rack ("FSR") point-of-purchase displays. A conventional HSR is half the height of a mountable racking system used on the sides of end caps on an aisle shelving unit, and a conventional FSR is the full height. A mountable racking system is a metal wire mesh unit to which the displays can be attached at store level. Alternatively, the displays disclosed herein can be used in other applications.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A display for products, comprising:

a sheet of material having a fold line dividing the sheet into a front panel and a rear panel, wherein the sheet folds along the panel fold line to a folded position with the panel fold line at a to of the front and rear panels, the front panel comprising a plurality of hanger openings and a plurality of flaps formed in the front panel immediately adjacent to each other with the hanger openings positioned immediately above the flaps, wherein each of the flaps has a top free edge and a bottom fold line that it folds along between a closed position and an open position, flap openings are defined by spaces in the front panel that are vacated by the flaps when the flaps are folded to the open position, and corresponding pairs of the hanger openings and the flap openings are immediately adjacent to and in communication with each other to form a single continuous opening when the flaps are in the open position; and a plurality of hangers that hold the products during display, wherein the hangers each include a base and a hanger arm that extends forward from the base, the bases are mounted to the rear panel, the hanger arms swing through the single continuous openings formed by the immediately adjacent hanger and flap openings when the flaps are in the open position and the sheet is being folded to the folded position, the flap openings provide clearance for the hanger arms to swing through when the flaps are in the open position, the hanger openings by themselves provide insufficient clearance for the hanger arms to swing through when the flaps are in the closed position, and the hanger arms extend through the hanger openings, frictionally contact and interlock with the flaps, and are supported by the top free edges of the flaps when the flaps are in the closed position and the products are mounted to the hanger arms.

2. The display of claim 1, wherein in the closed position the flaps are generally flush with the front panel and in the open position the flaps are pivoted forward from the front panel.

3. The display of claim 1, wherein in the folded position the front panel and the rear panel lie immediately adjacent each other in a generally flat arrangement.

4. The display of claim 1, wherein the sheet is made of a corrugate material.

5. The display of claim 1, wherein the hanger arms have free ends that are angled upward to form hooks that retain the products on the hanger arms.

6. The display of claim 1, wherein the hangers have hooks extending rearwardly from the hanger bases and the rear panel has mounting openings formed in it that receive the hanger-base hooks to secure the hangers to the rear panel.

7. The display of claim 1, wherein the flaps each have at least one vertical side extension that partially defines the corresponding hanger opening.

8. The display of claim 1, wherein the fold line that defines the front and rear panels and the fold lines that permit the flaps to pivot to the open positions are formed by scoring the sheet.

9. A pre-assembled package comprising the display and the products of claim 1, wherein the display is assembled and the products are mounted to the hangers prior to shipment.

10. A side rack display for products, comprising:

a sheet of corrugate material having a fold line dividing the sheet into a front panel and a rear panel, wherein the sheet folds along the panel fold line to a folded position in which the front panel and the rear panel lie immediately adjacent each other in a generally flat arrangement with the panel fold line at a to of the front and rear panels, the front panel comprising a plurality of hanger openings and a plurality of flaps formed in the front panel with the hanger openings positioned immediately above the flaps, wherein each of the flaps has a top free edge and a bottom fold line that it folds along between a closed position and an open position, in the closed position the flaps are generally flush with the front panel, in the open position the flaps are pivoted forward from the front panel about the bottom flap fold line, flap openings are defined by spaces in the front panel that are vacated by the flaps when the flaps are folded to the open position, corresponding pairs of the hanger openings and the flap openings are immediately adjacent to and in communication with each other to form a single continuous opening when the flaps are in the open position; and a plurality of hangers that hold the products during display, wherein the hangers each include a base and a hanger arm that extends forward from the base, the bases are mounted to the rear panel, the hanger arms have free ends that are angled upward to form hooks that retain the products on the hanger arms, the hanger arms swing through the single continuous openings formed by the immediately adjacent hanger and flap openings with the flap openings providing clearance for the hanger arms to swing through when the flaps are in the open position and the sheet is being folded to the folded position, the hanger openings by themselves provide insufficient clearance for the hanger arms to swing through when the flaps are in the closed position, and the hanger arms extend through the hanger openings and frictionally contact and interlock with and are supported below by the top free edges of the flaps when the flaps are in the closed position and the products are mounted to the hanger arms.

11. The display of claim 10, wherein the hangers have hooks extending rearwardly from the hanger bases and the rear panel has mounting openings formed in it that receive the hanger-base hooks to secure the hangers to the rear panel.

12. The display of claim 10, wherein the flaps each have at least one vertical side extension that partially defines the corresponding hanger opening.

13. The display of claim 10, wherein the fold line that defines the front and rear panels and the fold lines that permit the flaps to pivot to the open positions are formed by scoring the sheet.

14. A pre-assembled package comprising the display and the products of claim 10, wherein the display is assembled and the products are mounted to the hangers prior to shipment.

* * * * *